US011214913B2

(12) United States Patent
Cinello et al.

(10) Patent No.: US 11,214,913 B2
(45) Date of Patent: Jan. 4, 2022

(54) HOUSEHOLD APPLIANCE

(71) Applicant: Electrolux Appliances Aktiebolag, Stockholm (SE)

(72) Inventors: Mauro Cinello, Porcia (IT); Daniele Da Riol, Porcia (IT); Helena Romito, Porcia (IT); Alberto Santarossa, Porcia (IT)

(73) Assignee: Electrolux Appliances Aktiebolag

( * ) Notice: Subject to any disclaimer, the term of this patent is extended or adjusted under 35 U.S.C. 154(b) by 24 days.

(21) Appl. No.: 16/606,413

(22) PCT Filed: Apr. 26, 2017

(86) PCT No.: PCT/EP2017/059990
§ 371 (c)(1),
(2) Date: Oct. 18, 2019

(87) PCT Pub. No.: WO2018/196971
PCT Pub. Date: Nov. 1, 2018

(65) Prior Publication Data

US 2021/0115614 A1 Apr. 22, 2021

(51) Int. Cl.

| | |
|---|---|
| ***D06F 39/02*** | (2006.01) |
| ***D06F 23/02*** | (2006.01) |
| *D06F 39/08* | (2006.01) |

(52) U.S. Cl.
CPC ..... *D06F 39/028* (2013.01); *D06F 23/02* (2013.01); *D06F 39/088* (2013.01)

(58) Field of Classification Search
None
See application file for complete search history.

(56) References Cited

U.S. PATENT DOCUMENTS

| | | | | |
|---|---|---|---|---|
| 5,791,168 | A * | 8/1998 | Smock | D06F 39/028 68/12.18 |
| 5,884,506 | A * | 3/1999 | Blauert | D06F 39/02 68/17 R |
| 2012/0096903 | A1 | 4/2012 | Kim et al. | |
| 2018/0363196 | A1* | 12/2018 | Lee | D06F 37/02 |

FOREIGN PATENT DOCUMENTS

| | | | | |
|---|---|---|---|---|
| CN | 102560974 | A | 7/2012 | |
| DE | 102005003698 | A1 | 7/2006 | |
| EP | 2975171 | A1 | 1/2016 | |
| JP | 2007313214 | A | 12/2007 | |
| WO | 2016101994 | A1 | 6/2016 | |
| WO | WO-2016101994 | A1 * | 6/2016 | D06F 39/028 |

OTHER PUBLICATIONS

International Search Report and Written Opinion for International Application No. PCT/EP2017/059990, dated Dec. 20, 2017, 13 pages.
Chinese Office Action for Chinese Application No. 201780089989.X, dated May 24, 2021, 9 pages.

* cited by examiner

*Primary Examiner* — Cristi J Tate-Sims
(74) *Attorney, Agent, or Firm* — RatnerPrestia

(57) ABSTRACT

A household appliance having a casing, a washing tub for receiving laundry, a detergent dispenser to convey detergent/treating agents to the washing tub, and an inlet water unit for controlling and supplying water to the detergent dispenser and/or the tub. The inlet water unit includes a valve body having at least one inlet configured to connect to a water supply and outlets for connection to the detergent dispenser and/or the tub. The outlets are arranged in at least two rows in the valve body.

18 Claims, 12 Drawing Sheets

HOUSEHOLD APPLIANCE

This application is a U.S. National Phase application of PCT International Application No. PCT/EP2017/059990, filed Apr. 26, 2017, which is incorporated by reference herein.

FIELD OF THE INVENTION

The invention relates to a household appliance.

BACKGROUND ART

Nowadays the use of household appliances is widespread. Household appliance are, for example, refrigerators, cooling appliances, as well as laundry treatment machines, both "simple" laundry washing machines (i.e. laundry washing machines which can only wash and rinse laundry) and laundry washing-drying machines (i.e. laundry washing machines which can also dry laundry), or drying machines (i.e. drying machines which can dry laundry).

Washing machines in households, also called domestic washing machines, are well-known and usually are used for washing laundry. Washing machines usually comprise washing tubs in which a rotatable drum is housed for receiving goods to be washed, usually laundry. Washing liquid is introduced into the washing tub, which washing liquid consists only of water or mainly of water and detergents or washing or cleaning agents added to or dissolved in the water for improving the washing quality.

In the present description the term "laundry treatment appliance" will refer to simple laundry washing machines, laundry washing-drying machines or drying machines. Laundry treatment appliances such as washing or washing-drying machines generally comprise an external casing provided with a washing tub which contains a rotatable perforated drum where the laundry is placed. A loading/unloading door ensures access to the drum. Laundry treatment appliances typically comprise a water supply unit and a products supply unit, preferably a drawer, for the introduction of water and washing/rinsing products (i.e. detergent, softener, rinse conditioner, etc.) into the tub. Known laundry treatment appliances are also provided with water draining devices that may operate during different phases of the washing program to drain the dirty water from the tub.

According to the known art, a complete laundry treating program typically includes different phases during which the laundry to be washed is subjected to adequate treatments. A treating cycle usually comprises a main washing phase during which the laundry is treated by means of water and a detergent. The water is typically heated to a pre-determined temperature based on the washing program selected by the user. It is also possible that hot water is introduced into the tub from the hot water mains. During the main washing phase the drum is rotated, so as to apply also a mechanical cleaning action on the laundry. At the end of the main washing phase the drum is typically rotated at high rotational speed, so in such a way that dirty washing liquid (i.e. water mixed with detergent) is extracted from the laundry, and this dirty washing liquid is drained to the outside by the water draining devices.

A laundry treatment program usually comprises one or more rinsing phases in which typically a rinsing product which is provided in a compartment of the dispenser/drawer is flushed into the tub together with fresh water or in which fresh water is flushed into the tub directly. These phases which are typically subsequent to a washing phase typically comprise one or more rinsing cycles/steps. In a rinsing cycle or phase, clean rinse water may be first added to the laundry. The rinse water is absorbed by the laundry and the rinse water removes from the laundry detergent and/or dirty water not previously removed by washing liquid in the main washing cycle. The drum is then rotated to extract water and dirty water/detergent from the laundry: the dirty water extracted is drained from the tub to the outside by the water draining devices.

A household appliance typically comprises an inlet water unit connected to the water mains/external water supply. The inlet water unit on demand allows water from the external supply to flow through an outlet into the tub or into a chamber of the detergent dispenser. In order to stop or allow water flow on demand, the inlet water unit typically comprises several solenoid valves with bobbins that are activated on demand during different times of the washing cycle. The concrete number of bobbins is linked to the number of water channels communicating with the chambers of the detergent dispenser; in case several detergents/agents have to be used during a specific program, several chambers have to be provided on the drawer respectively, to distinctly collect said detergents/agents; in order to flush each of them at the right time pursuant to the selected program, a suitable channel has to provide water inside the respective chamber. Due to the several detergents/agents to be managed during a machine program, the selective allowance or stop of water flow toward each chamber requires a large amount of water channels communicating with the detergents/agents chambers, and consequently a large amount of outlets provided on the inlet water unit, causing an increasing of dimensions of the inlet water unit.

SUMMARY OF THE INVENTION

The aim of the invention is to provide a household appliance with an inlet water unit which needs only a small installation space due to its compact structure.

It is a further aim of the invention to provide a household appliance with an inlet water unit requiring easier/cheaper manufacturing processes.

The invention therefore relates to a household appliance comprising a casing, a washing tub for receiving laundry, a detergent dispenser to convey detergent/treating agents to the washing tub, an inlet water unit for controlling and supplying water to the detergent dispenser and/or the tub, whereby the inlet water unit comprises a valve body comprising at least one inlet configured to connect to a water supply and comprising a plurality of outlets for connection to the detergent dispenser and/or the tub, whereby the outlets are arranged in at least two rows in the valve body.

The spatial arrangement in a row means that the outlets are arranged in a common plane. An arrangement of outlets in several rows means that these outlets are arranged in several planes, i.e. for instance a first number of outlets is arranged in a first plane and a second number of outlets is arranged in a second plane. Preferably, these planes are arranged parallel to each other. Preferably, for several outlets arranged in a single row is intended that the centers of a group of outlets are aligned each other along an ideal straight line.

The invention is based on the consideration that the inlet water unit is an important component which at the same time needs a considerable amount of installation space. Especially if the appliance offers a variety of treatment programs/options, several water flow paths have to be realized by a corresponding number of outlets. This requirement leads to a complicated compact design or a cumbersome configuration using considerable space.

Applicant has found that it is possible to realize an inlet water unit which simultaneously has a compact design and robust design by arranging the outlets in two or more rows or planes. In this way, the width of the water inlet unit can be kept rather small. At the same time, this design allows to build a robust design of the arrangement of the valve actuators which on demand allow or prevent water flow through these outlets.

The valve body is preferably built as a valve block. The valve block preferably comprises a common casing which is built to receive plurality of valve actuators and comprises respective channels which can be fluidly opened or closed by the valve actuators.

Preferably, the detergent dispenser comprises a drawer received in a drawer housing, whereby the valve body is connected to a receiving body which is provided on the drawer housing. The drawer preferably comprises at least one, most preferably several compartments for receiving laundry treatment products such as detergent, rinsing agent, bleaching agent etc.

Advantageously at least one outlet of the inlet water unit is respectively connected to a channel of the receiving body by a sealing element.

The sealing element is preferably respectively built as a gasket. It is preferably made of rubber.

In a preferred embodiment, the receiving body is integrated with the drawer housing. The inlet water unit is preferably connected to the receiving body by a screw connection. Alternatively or additionally, the connection can also by realized by gluing and/or a snap connection.

Preferably, the drawer comprises at least one detergent compartment and the drawer housing is being associated with a flushing device, whereby the flushing device comprises at least one channel communicating with the drawer compartment and a channel in the receiving body.

Each channel of the receiving body preferably comprises an inlet horizontal channel communicating with a respective outlet vertically/inclined disposed to communicate with the flushing device. This configuration allows the design of a compact valve also along the depth direction of the drawer viewed from the front side of the machine, because the water channels are developed along the vertical direction too.

Advantageously, the flushing device in a mounted state of the appliance is arranged at least partially on top of the drawer housing. In this way, a compact design is achieved and the respective length of the channels of the flushing device and be realized comparatively small.

Preferably the valve body is configured to receive at least one valve actuator for selectively putting in fluid communication, i.e. providing a fluid connection of, the respective at least one inlet with at least one outlet.

Preferably, at least one valve actuator is built as a solenoid valve. Most preferably, each valve actuator is built as a solenoid valve.

In a preferred embodiment, for each of the outlets, a solenoid valve is provided for opening and closing the outlet. In other words, for each outlet, a solenoid valve is arranged for allowing or preventing water flow through the outlet.

Preferably, each of the at least two rows comprises at least two outlets.

Preferably, a first row comprises three outlets, whereby a second row comprises two outlets.

Preferably, valve actuators provided for connecting at least one inlet with outlets of the second row are arranged closer to the at least one inlet than valve actuators provided for connecting at least one inlet with outlets with the first row.

Preferably, in a mounted state, the first row is arranged on a higher elevation compared to the second row.

In a preferred embodiment, the detergent dispenser comprises at least two crossing channels configured for crossing of water streams, and whereby said crossing channels are fluidly connected to outlets of said inlet water unit which are arranged in the same row.

The invention also relates to a household appliance comprising a casing, a washing tub for receiving laundry, a detergent dispenser to convey detergent/treating agents to the washing tub, a receiving body with a plurality of inlets which is configured for fluid connection to an inlet water unit which comprises a valve body comprising at least one inlet configured to connect to a water supply and comprising a plurality of outlets for connection to the detergent dispenser and/or the tub, whereby the inlets of the receiving body are arranged in at least two rows.

The advantages of the invention are especially as follows. The arrangement of outlets of the inlet water unit in several rows allows realizing a compact unit which can be manufactured with a reduced material need, thereby at the same time saving installation space and manufacturing cost.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

Identical parts are labelled by the same reference numbers.

DETAILED DESCRIPTION OF EXEMPLARY EMBODIMENTS

Figure 1:
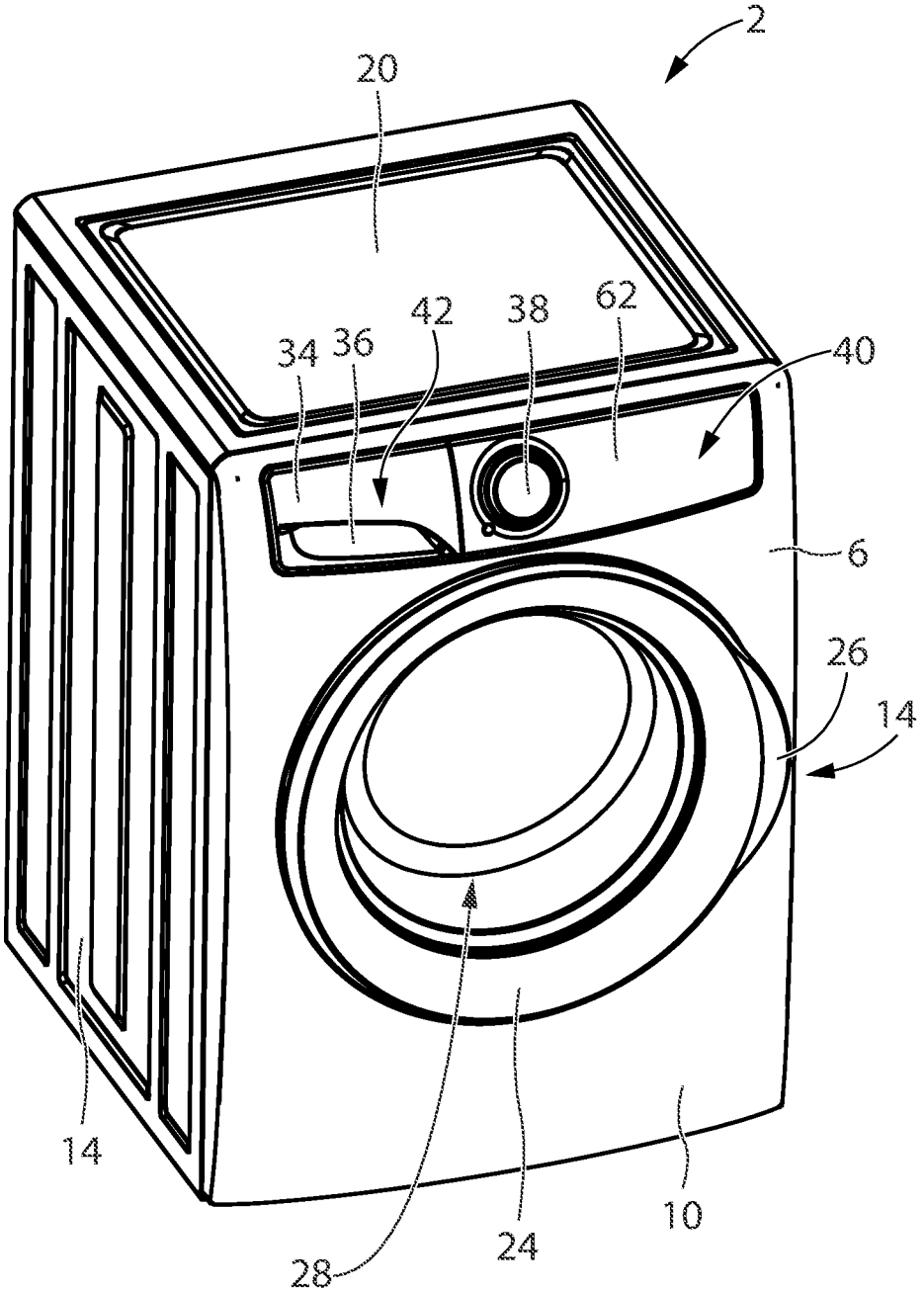
FIG. 1 shows a front-loading washing machine in a preferred embodiment in a perspective view.
Figure 2:
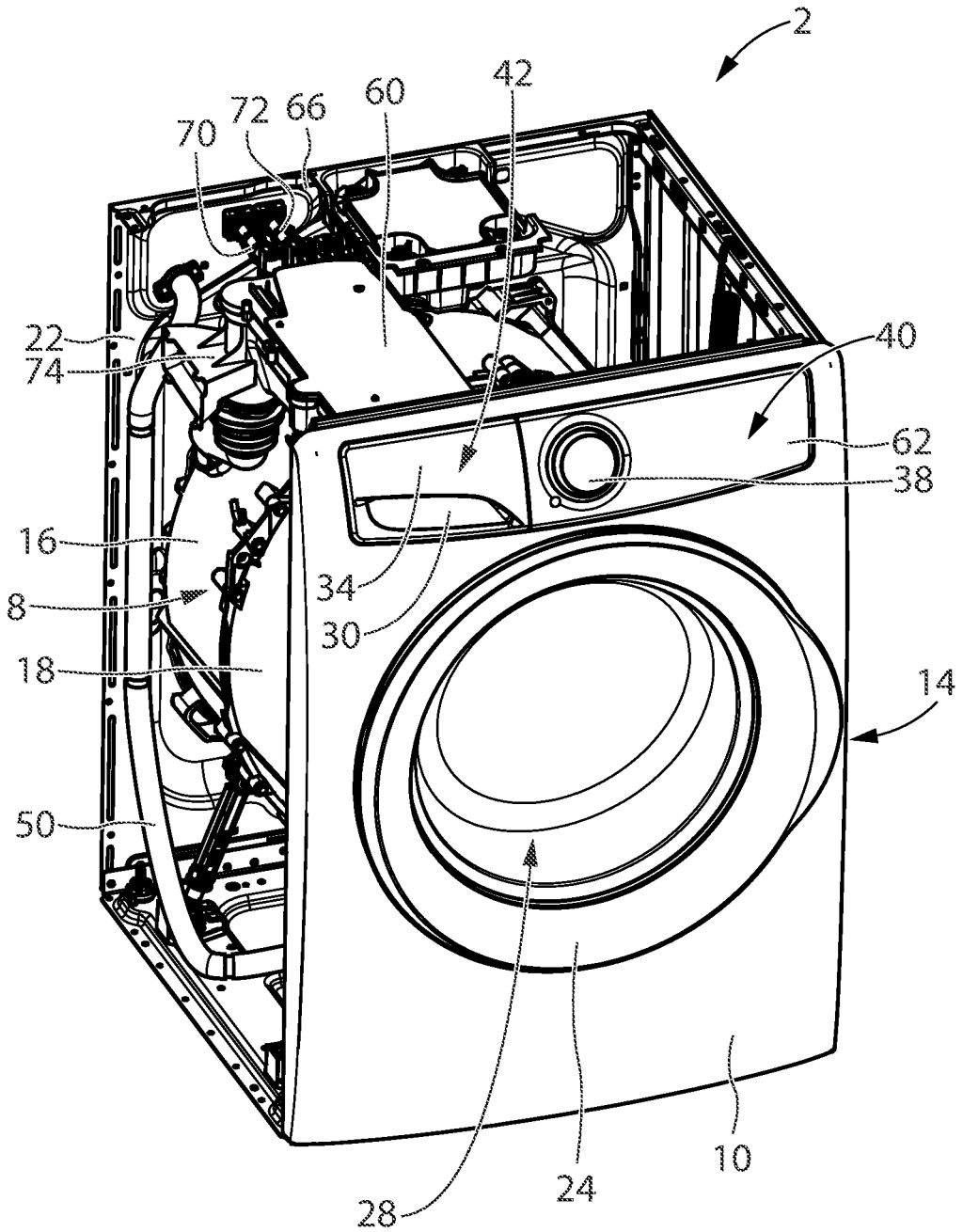
FIG. 2 shows the front-loading washing machine of FIG. 1 with its casing partially removed.

In FIGS. 1 and 2, a household appliance 2 is shown which is built as a front-loading washing machine and comprises housing or casing 6 with a preferable parallelepiped shape, the casing 6 comprising a front wall 10, two side walls 14, a cover plate 20 and a rear wall 22. Front wall 10 and side walls 14 are preferably part of a cabinet. A front door 24 is provided which can be opened for loading or unloading laundry through an opening 28 into a washing drum and which can be closed. Door 24 can be preferably operated, especially opened and closed, by a handle 26.

Advantageously a washing tub 8 is contained within casing 6, whereby a rotatable and perforated drum is contained by the washing tub 8. Both washing tub 8 and drum have a preferable substantially cylindrical shape. Advantageously the tub is suspended in a floating manner inside casing 6 by means of a number of coil springs and shock absorbers. The drum is rotated by an electric motor, which transmits the rotating motion of a motor shaft to the drum by a belt/pulley system. In a different embodiment of the invention, the motor can be directly associated with the shaft of the drum. The tub is preferable connected to casing 6 by means of an elastic bellows or gasket. The tub preferably comprises two complementary hem i-shells structured for being reciprocally coupled to form tub. Alternatively, the household appliance can be a combined washer and dryer.

The preferred washing machine shown in FIGS. 1 and 2 on a front panel 40 comprises a drawer 42 with a front plate 34 and a handle 36 for pulling out and pushing back the drawer 42. Drawer 42 comprises at least one compartment for receiving detergent or washing additives.

Adjacent to drawer 42, preferably a rotatable or rotary knob 38 is arranged for selecting a laundry treatment program and/or at least one parameter of a laundry treatment program. Preferably, knob 38 has also a push-functionality and can be pressed for selected and/or confirmation of selected options. Knob 38 is preferably provided on a control panel 62 which can provide further indicating and/or control elements. Knob 38 is preferably arranged on front panel 40 adjacent to drawer 42. On control panel 62, preferably a touch display is arranged. Household appliance 2 preferably comprises an ON/OFF button for switching on or off the machine. A service door (not shown) is preferably arranged on front wall 10 which can be opened to access a filter unit.

A drain pipe 50 is fluidly connected to tub 8 and to rear wall 22 for transporting liquid to the outside of appliance 2. A flushing device 60 is arranged on top of a detergent dispenser in which drawer 34 can be inserted. An inlet water unit 66 is via two pipes 70, 72 connected to entrances on rear wall 22 for connection with water mains/an external water supply. An overflow channel 74 is provided to allow water flow from the flushing device 60 (in case of sudden overflow, i.e. valve damages) to the bottom side of the washing machine.

Figure 3:
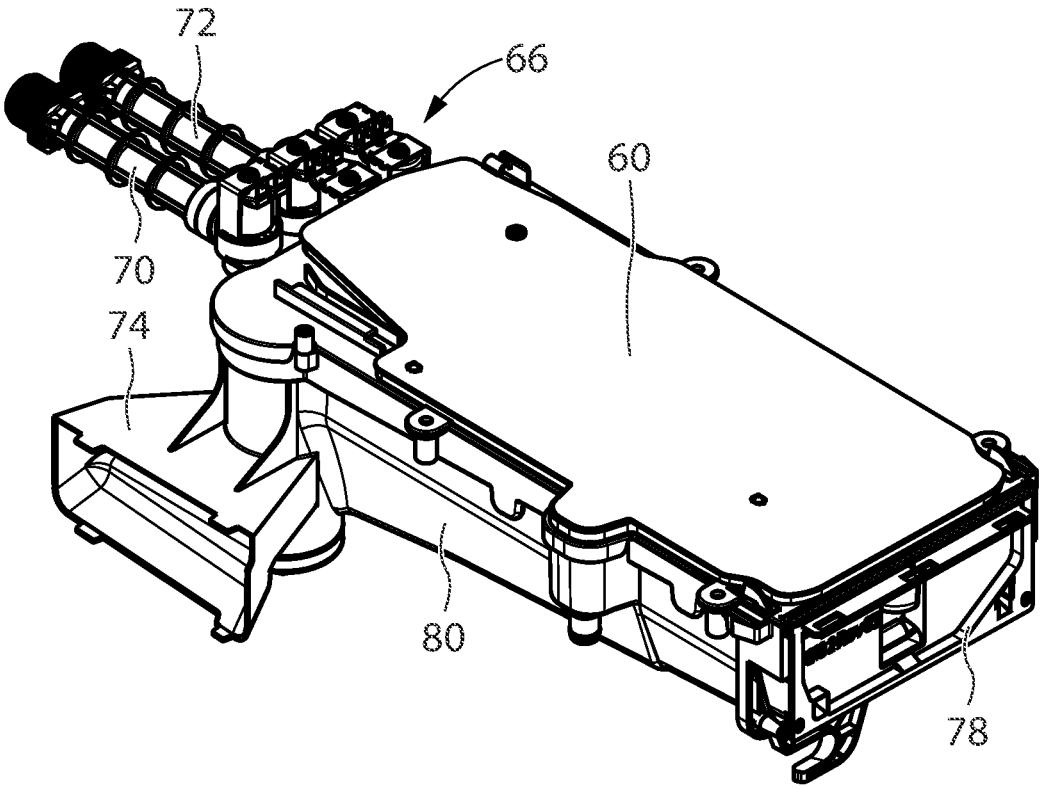
FIG. 3 shows a flushing device, a detergent dispenser and an inlet water unit of front-loading machine according to FIG. 2 in a first perspective view.
Figure 4:
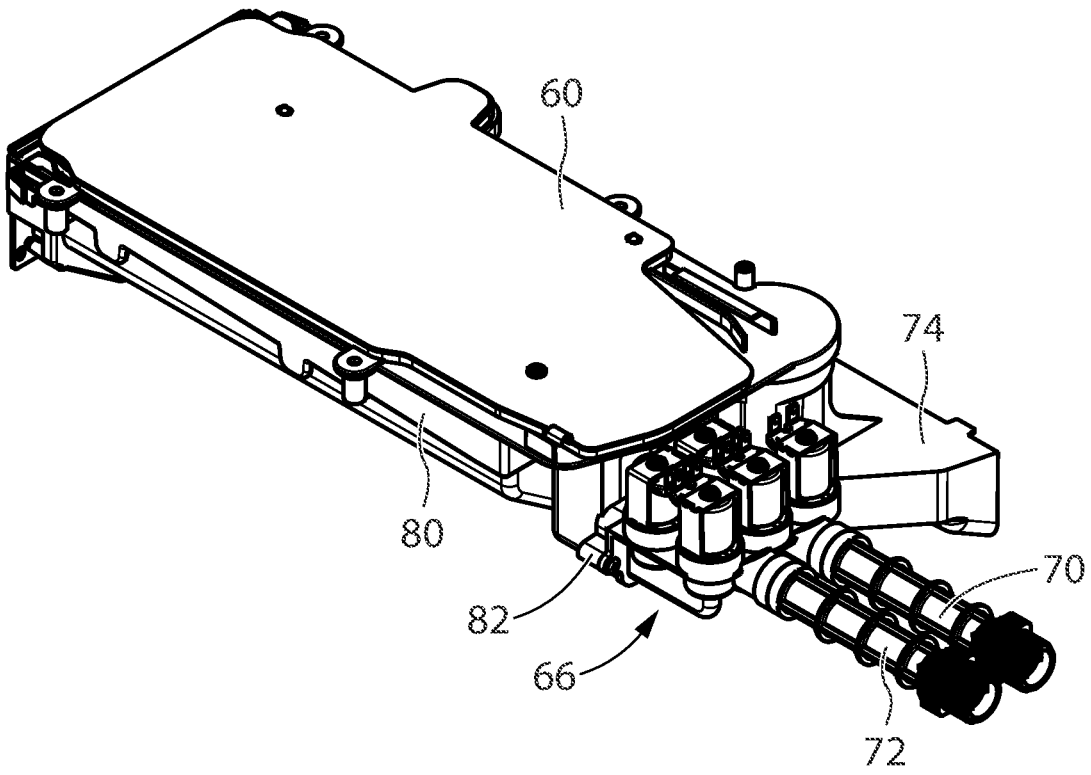
FIG. 4 shows the flushing device, detergent dispenser and inlet water unit of front-loading machine according to FIG. 2 in a second perspective view.
Figure 5:
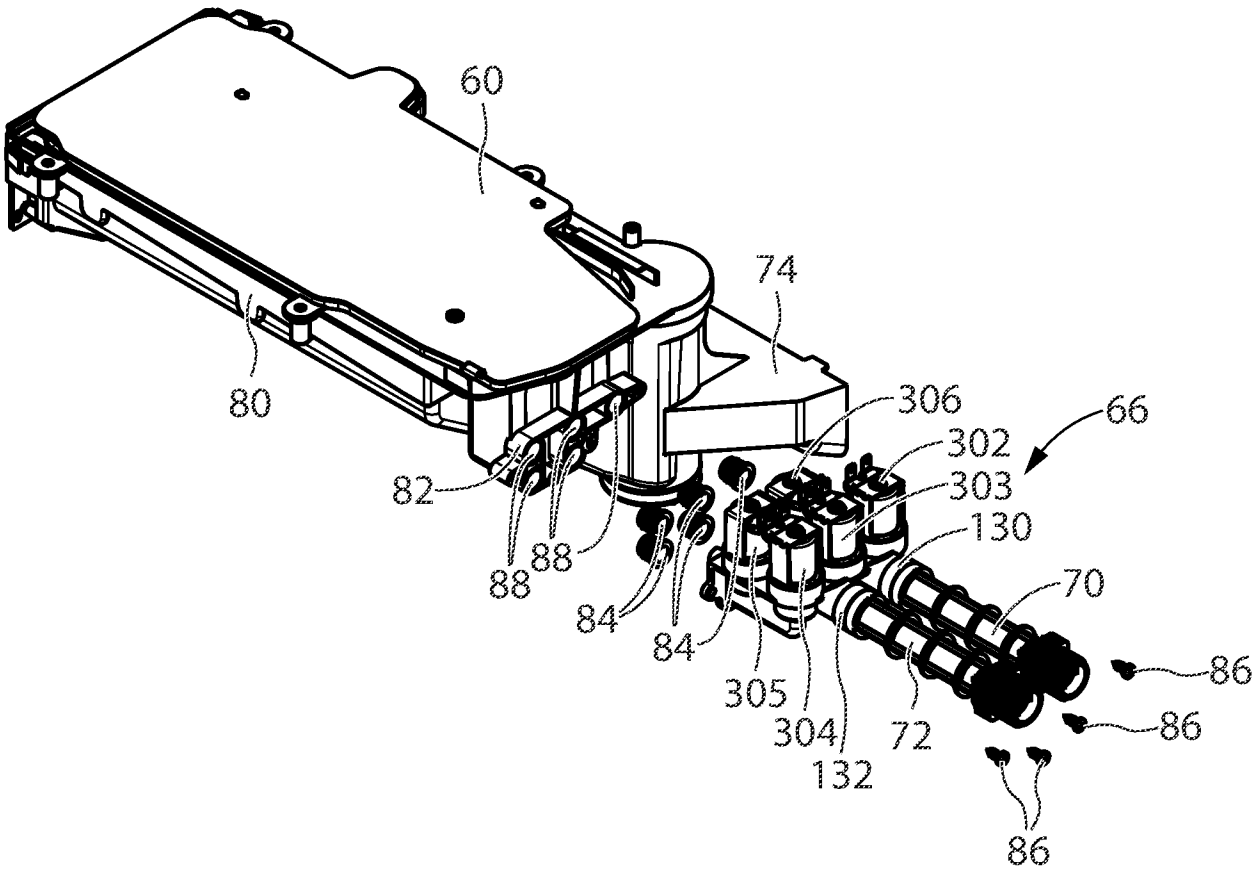
FIG. 5 shows the flushing device, detergent dispenser and inlet water unit of front-loading machine according to FIG. 2 in an exploded view.

In FIGS. 3, 4 and 5, the flushing device 60 is shown which is mounted on top of a detergent dispenser 80. As known, the flushing device 60 comprises several channels configured to allow the water coming from the inlet valve unit to selectively flow toward the detergent/additives/agents compartments provided on the drawer 34. A receiving body 82 is provided which preferably is built in an integrated way with the detergent dispenser 80/flushing device 60. Preferably, receiving body 82 and detergent dispenser 60 are built of the same material in a common manufacturing process. The receiving body 82 which preferably is built as a block comprises a plurality of inlets 88 which are preferably connected to channels. In a mounted state, each of these inlets 88 is respectively connected to an outlet of inlet water unit 66. The respective connection is preferably sealed by a respective sealing element 84 which is advantageously built as a gasket. Preferably, inlet water unit 66 is attached to receiving body 82 with a screw connection, especially by four screws 86. Inlet water unit 66 preferably comprises two inlet ports 130, 132 for fluidly connecting to an external water supply, whereby in a mounted state inlet port 130 connects to pipe 70 (preferably connected to the hot water mains) and inlet port 132 connects to pipe 72 (preferably connected to the cold water mains). Also seen in FIG. 3 is the drawer housing 78.

Figure 6:
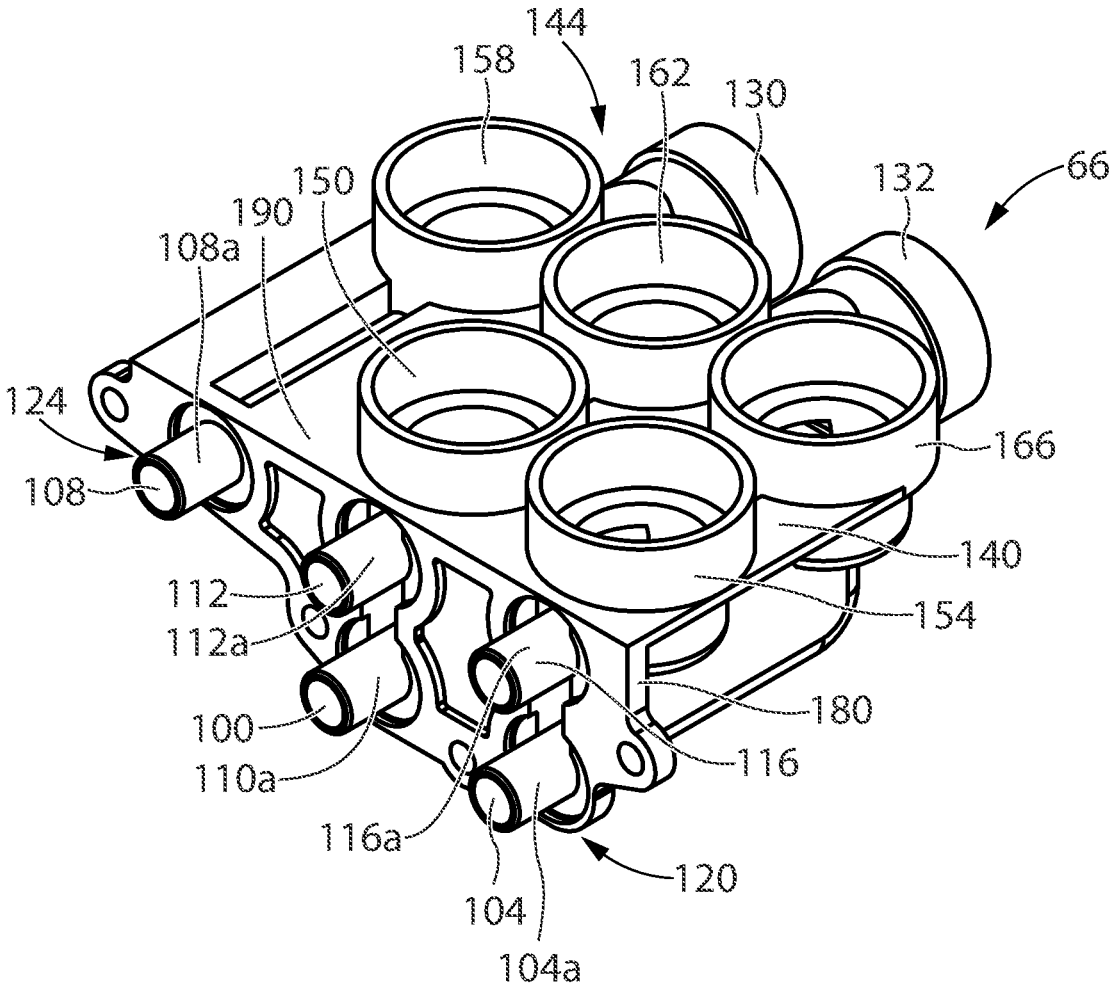
FIG. 6 shows the inlet water unit in a perspective view.

The inlet water unit 66 shown in a perspective view in FIG. 6 comprises five outlets 100, 104, 108, 112, 116 which in the mounted state are received by the corresponding inlets 88 of receiving body 82. The outlets 100, 104, 108, 112, 116 are arranged in two rows 120, 124. In a first row, two outlets 100, 104 are arranged. In a second row 124, three outlets 108, 112, 116 are arranged. The row 120 defines a first plane and the row 124 defines a second plane. In the first plane, the two outlets 100, 104 are arranged and in the second plane, the three outlets 108, 112, 116 are arranged. This means that the axial outlets at least partially lie in a common plane. This arrangement of the outlets 100-116 allows providing a compact design of the inlet water unit 66 which requires only a considerably small installation space within casing 6. Additionally, the inlet water unit 66 can be manufactured in a single manufacturing process, especially by molding. Since it provides a compact design, the amount of needed material can be considerably reduced compared common designs. Inlet water unit 66 therefore essentially consists of a body 140 which preferably is built by injection molding. Each outlet 100, 104, 108, 112, 116 at an end comprises an outlet port 100*a*, 104*a*, 108*a*, 112*a*, 116*a* for connection with the receiving body 82. The corresponding outlet port 100*a*-116*a* therefore is essentially an end portion of the respective outlet 100-116.

Inlet water unit 66 comprises a valve body 144 which is part of the body 140 and comprises several valve seats 150, 154, 158, 162, 166. In each of these valve seats, a valve actuator 302, 303, 304, 305, 306 (compare with FIGS. 12, 13, 14) is received for controlling flow of liquid though the corresponding outlet 100-116. Preferably, each valve actuator 302, 303, 304, 305, 306 comprises a movable body able to open/close the passage between an inlet and an outlet, as below described, though its sliding between the open and the closed position; these positions are preferable assured by a solenoid bobbin associated to a respective movable body, so that though an electric signal/supply said bobbin provides to switch the movable body from an open to a closed position or vice versa. The inlet water unit 66 is show in FIG. 6 in its position and orientation when it is mounted in household appliance 2 and connected to receiving body 82. The row 120 is preferably located at a lower elevation than the row 124, see also FIG. 12.

Figure 7:
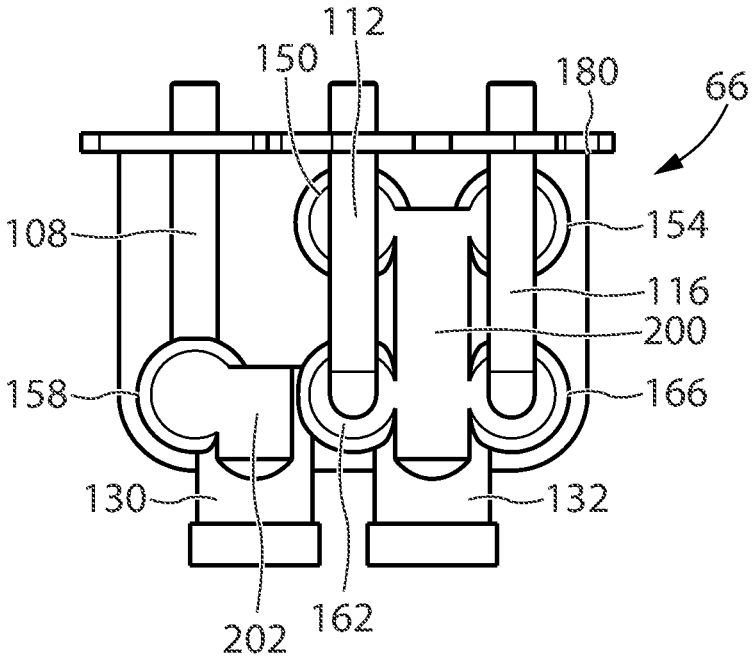
FIG. 7 shows the inlet water unit in a bottom view.
Figure 8:
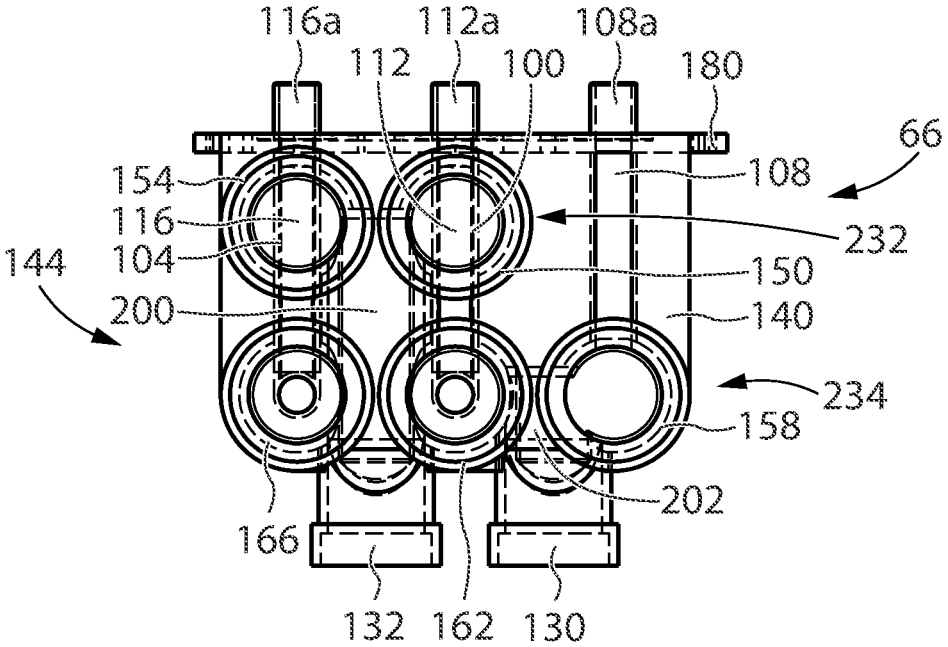
FIG. 8 shows the inlet water unit in a transparent top view.
Figure 13:
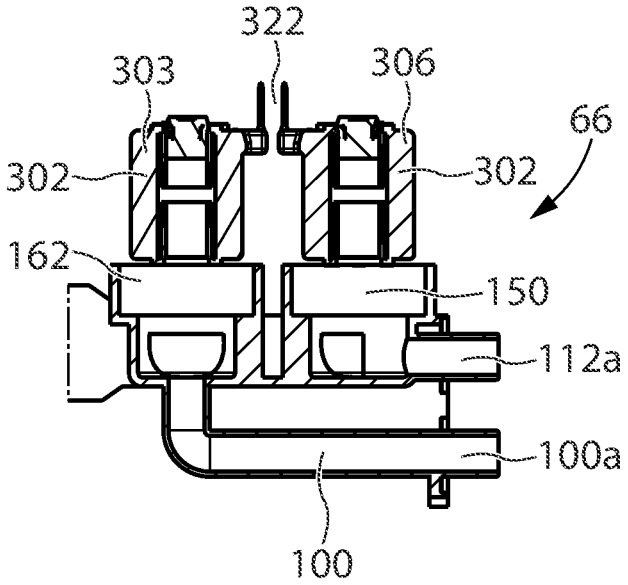
FIG. 13 shows the inlet water unit along a cut D-D in FIG. 12.

In FIG. 7, the bottom view of the inlet water unit 66 is depicted; in this view some protuberances 108, 112, 200, 116 from the valve body 144 are visible; said protuberances correspond to the channels connecting the inlets 130, 132 with the outlets 100, 104, 108, 112, 116; according to the preferred embodiment shown in FIGS. 7 and 8 the inlet 130, in which the pipe 70 is connected, communicate with the valve actuator seat 158 and then with the pipe 108 and the outlet port 108*a*; this means that if the valve actuator opens said passage, preferably though the switch of the bobbin of valve actuator 302 associated with the valve actuator seat 158, the water flows from the pipe 70 to the outlet port 108*a*; also according to the preferred embodiment shown in FIGS. 7 and 8 the inlet 132, in which the pipe 72 is connected, communicate with the valve actuator seats 150, 162, 154, 166; as shown in FIG. 13, when the water reaches the actuator seats 150, if the respective actuator (through the bobbin 306) open the passage, the water flows from the inlet 132 to the outlet port 112*a*; at the same way, when the water reaches the actuator seats 162, if the respective actuator (through the bobbin 303) open the passage, the water flows from the inlet 132 to the outlet port 100*a*.

Figure 14:
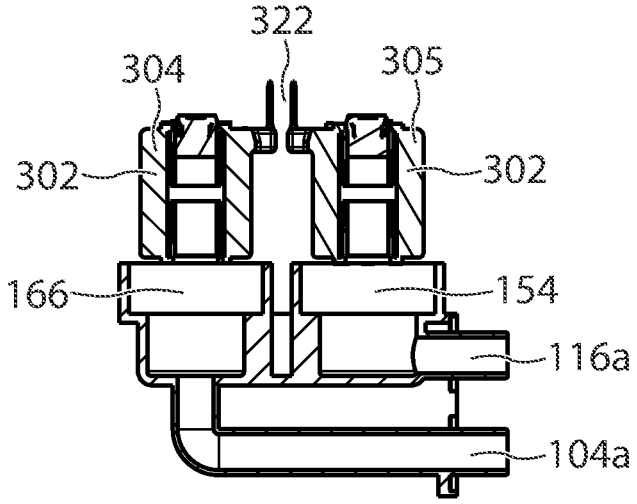
FIG. 14 shows the inlet water unit along a cut E-E in FIG. 12.

As shown in FIG. 14, when the water reaches the actuator seats 154, if the respective actuator (through the bobbin 305) open the passage, the water flows from the inlet 132 to the outlet port 116*a*; at the same way, when the water reaches the actuator seats 166, if the respective actuator (through the bobbin 304) open the passage, the water flows from the inlet 132 to the outlet port 104*a*.

In FIG. 8, inlet water unit 66 is show in a top view with some components removed. As can be inferred from this FIG. the outlets 108, 112, 116 are arranged parallel to each other in a plane. Also outlets 100, 104 are arranged in a common plane. Valve seats 166 and 154 are arranged in a line and parallel to an axis defined by the axial direction of, respectively, outlets 116 and 104. Valve seats 162 and 150 are arranged in a line and parallel to an axis or axial direction defined by outlet 112 or 100. While two groups of outlets are arranged in two rows 120, 124 which in the mounted state lie at different elevations, i.e. they are arranged in different heights or vertical positions, the valve seats 150, 154 are arranged in a first row 232 and the valve seats 158, 162, 166 are arranged in a second row 234. Rows 232 and 234 in the mounted state are arranged in the same horizontal plane. In this way, a very compact design of inlet water unit 66 can be realized.

Figure 9:
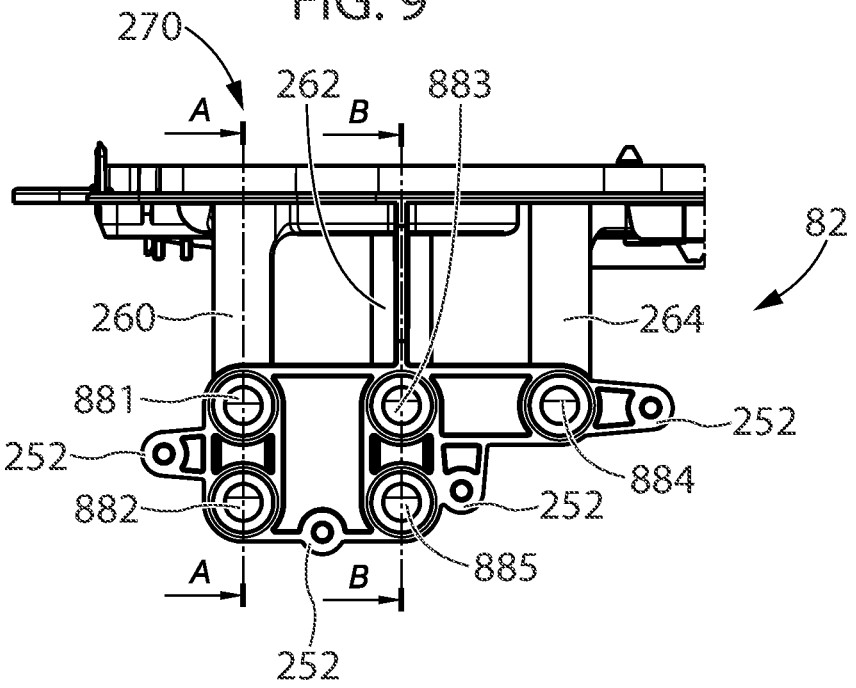
FIG. 9 shows a receiving body with some components removed.

In FIG. 9, receiving body 82 is shown in a frontal view with some components removed. Receiving body 82 comprises preferably four connecting elements 252 which respectively are built to receive a screw 86 (see FIG. 5) and therefore they could comprise an inner thread. Inlet water unit 66 preferably comprises corresponding connection elements 300 (see FIG. 12) with openings through which the respective screw 86 can be lead. Receiving body 82 comprises channels of which channels 260, 262, 264 are visible which lead from the corresponding inlet 881, 882, 883, 884, 885 to a top side 270 where they are built to fluidly connect with channels in the flushing device 60.

In the preferred embodiment in which the inlet water unit 66 is configured as shown in FIGS. 6-8 and 12-14, when the inlet water unit 66 is connected with the receiving body 82, the outlet port 116*a* is connected with the inlet 881 and the channel 260 (compare with FIG. 10), the outlet port 104*a* is connected with the inlet 882 and the channels 266 and 268 (compare with FIG. 10), the outlet port 112*a* is connected with the inlet 883 and the channel 262 (compare with FIG. 11), the outlet port 100*a* is connected with the inlet 885 and the channels 290 and 291 (compare with FIG. 11), whereas the outlet port 108*a* is connected with the inlet 884 and the channel 264; preferably, all connections between the inlet ports 116*a*, 104*a*, 112*a*, 110*a* and 108*a* are respectively connected to the respective inlets 881, 882, 883, 885 and 884 in a water-tight manner, preferable through the gaskets 84

Figure 10:
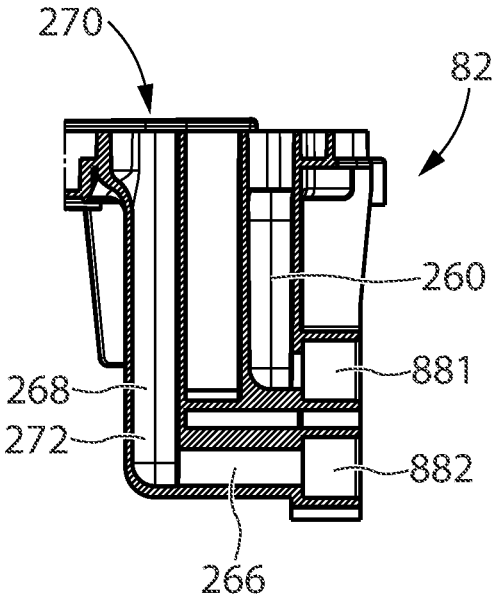
FIG. 10 shows the receiving body along a cut A-A in FIG. 9.
Figure 11:
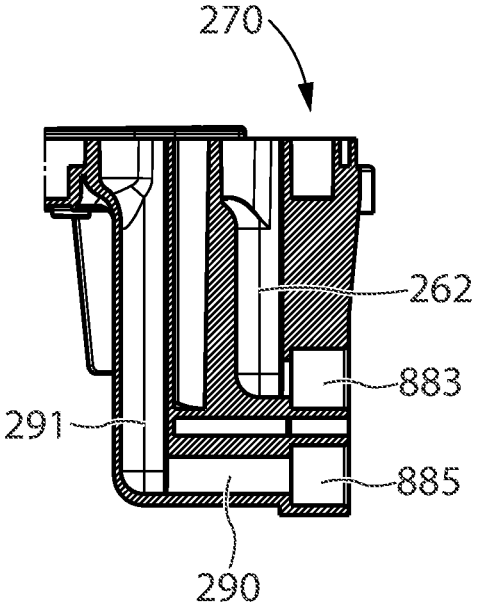
FIG. 11 shows the receiving body along a cut B-B in FIG. 9.

As can be seen in FIG. 10, which shows a cut along the line A-A in FIG. 9, the channel 260 preferably directly connects to inlet 881. Another channel 272 preferably has two channel sections 266, 268 which are fluidly connected with each other and are preferably arranged perpendicular to each other and preferably are built in one piece. The channel section 266 arranged directly adjacent to inlet 882 preferably runs parallel to top side 270 and the channel section 268 preferably runs perpendicular to channel section 266 and perpendicular to top side 270. Channel 260 and channel section 268 are preferably arranged perpendicular to each other. This alignment and arrangement of channels leads to a very compact design of receiving body 82. As can be seen in FIG. 11, which shows a cut through FIG. 9 along line B-B, channel 262 and a channel 291 are preferably arranged in a similar manner as channels 260 and 272 as shown in FIG. 11

Figure 12:
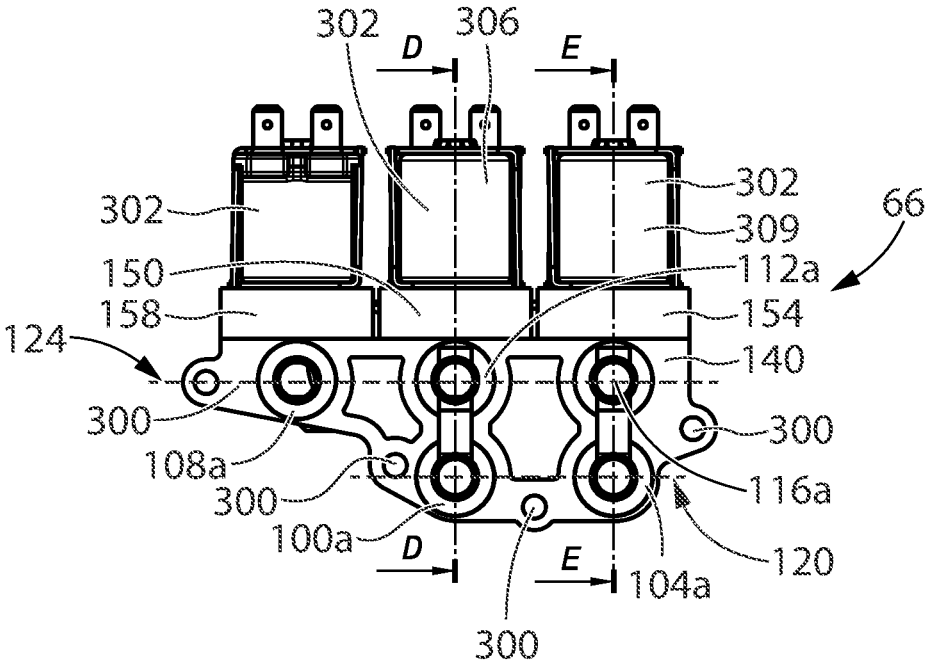
FIG. 12 shows the inlet water unit in a frontal view.

In FIG. 12, the inlet water unit 82 is shown in a frontal view. In each valve seat of inlet water unit 66 (shown are valve seats 158, 150, 154), a valve actuator 302 is inserted which respectively is preferably built as a solenoid valve. FIGS. 13 and 14 show inlet water units along cuts D-D and E-E, respectively. Shown are also electrical connectors 322 to the bobbins of the valve actuators.

As can be seen in the FIG. 12, the outlet ports 100*a*, 104*a*, 108*a*, 112*a*, 116 are arranged in two rows 120, 124. In a first row, the outlet ports 100*a*, 104*a* are arranged. In a second row 124, the outlet ports 108*a*, 112*a*, 116*a* are arranged. The row 120 defines a first plane and the row 124 defines a second plane. The expression that several outlets/outlet ports are arranged in the same row or plane in this context means that the centers of a group of outlets, especially the centers of a group (at least two) of the axial outlet ports 100*a*, 104, 108*a*, 112*a*, 116*a*, are aligned each other along a ideal straight line.

The configuration/spatial orientation of the inlet water unit 66 shown in FIG. 12 corresponds to its mounting position in which the row 120 is arranged below row 124 in vertical direction.

Figure 15:
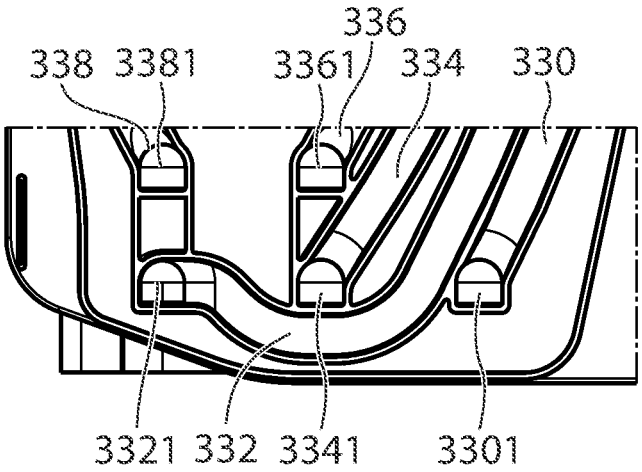
FIG. 15 shows a section through a flushing device.

In FIG. 15, a section through the flushing device 60 is shown in a manner to partially show the water channels 330, 332, 334, 336, 338. Flushing device 60 comprises several channels 330, 332, 334, 336, 338 which connect channels of the receiving body 82 with compartments of detergent dispenser 80 or allow a flow of water directly into the tub 8. According to the preferred embodiment shown in the FIGs, the channel 260 is connected to the flushing channel 332 through the aperture 3321 (see FIGS. 10 and 17), the channel 272 is connected to the flushing channel 338 through the aperture 3381 (see FIGS. 10 and 17), the channel 262 is connected to the flushing channel 334 through the aperture 3341 (see FIG. 11), the channel 291 is connected to the flushing channel 336 through the aperture 3361 (see FIG. 11), and the channel 264 is connected to the flushing channel 330 through the aperture 3301 (see FIG. 9).

Preferably, the flushing channels 336 and 338 are configured to be two crossing channels for crossing water streams when the water flows to said channels contemporaneously. According to the shown and above described embodiment, the channel 336 is connected to the channel 291 (through the aperture 3361), that is connected to the inlet 885 of the receiving body that in its mounting position is connected with the outlet port 100*a* of the inlet water unit 66; accordingly, the channel 338 is connected to the channel 272 (through the aperture 3381), that is connected to the inlet 882 of the receiving body that in its mounting position is connected with the outlet port 104*a* of the inlet water unit 66; consequently, according a preferred embodiment the two crossing channels 336, 338 are fluidly connected to the outlets 100*a*, 104*a* of said inlet water unit (66) which are arranged in the same row 120 (see FIG. 12).

Figure 16:
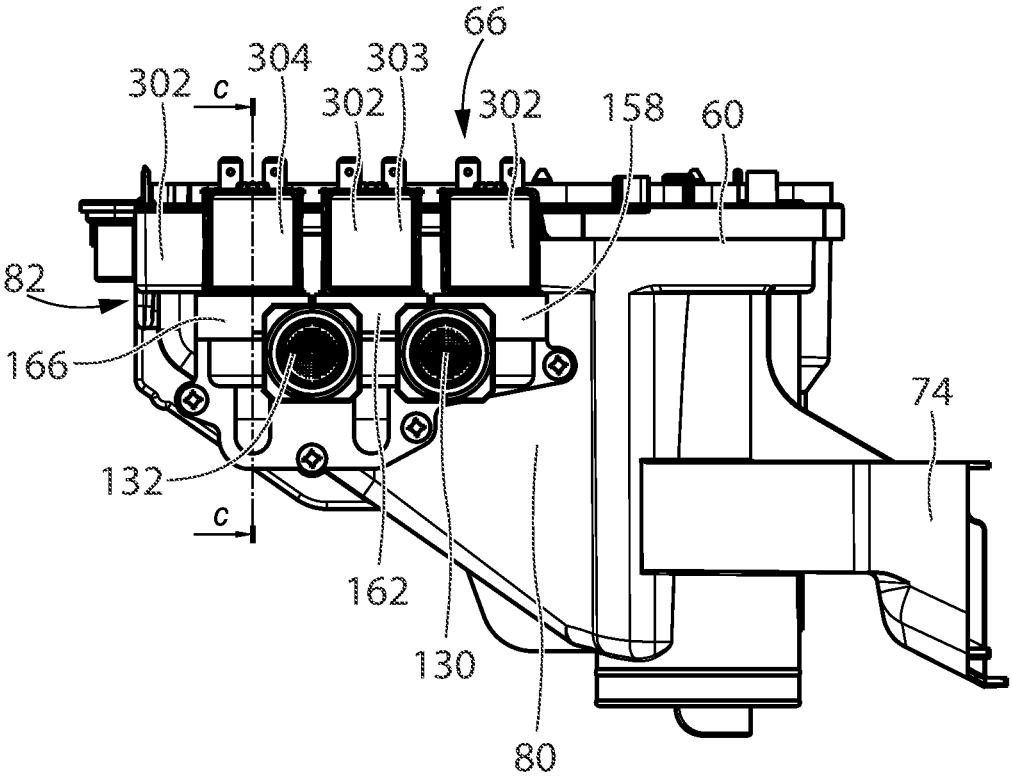
FIG. 16 shows inlet water unit, flushing device and detergent dispenser in a mounted configuration.
Figure 17:
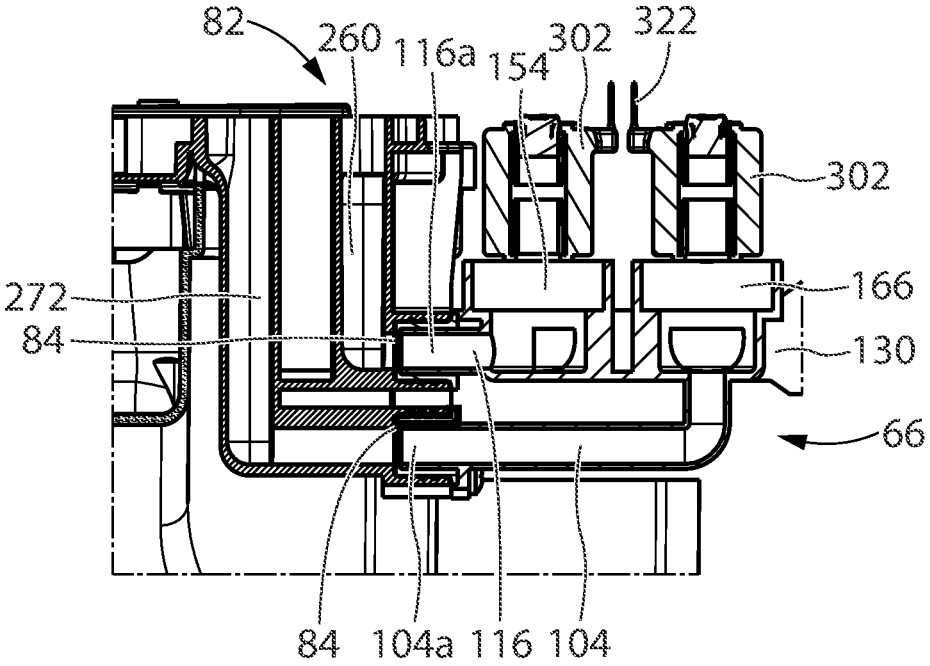
FIG. 17 shows a cut along the line C-C of FIG. 16.

FIGS. 16 and 17 shows inlet water unit 66 mounted on receiving body 82. The respective outlets ports (visible in FIG. 17 are outlet ports 104 *a* and 116 *a*) are connected to respective channels of receiving body 82 (visible are channels 260, 272) with gaskets 84 (see FIG. 5).

Figure 18:
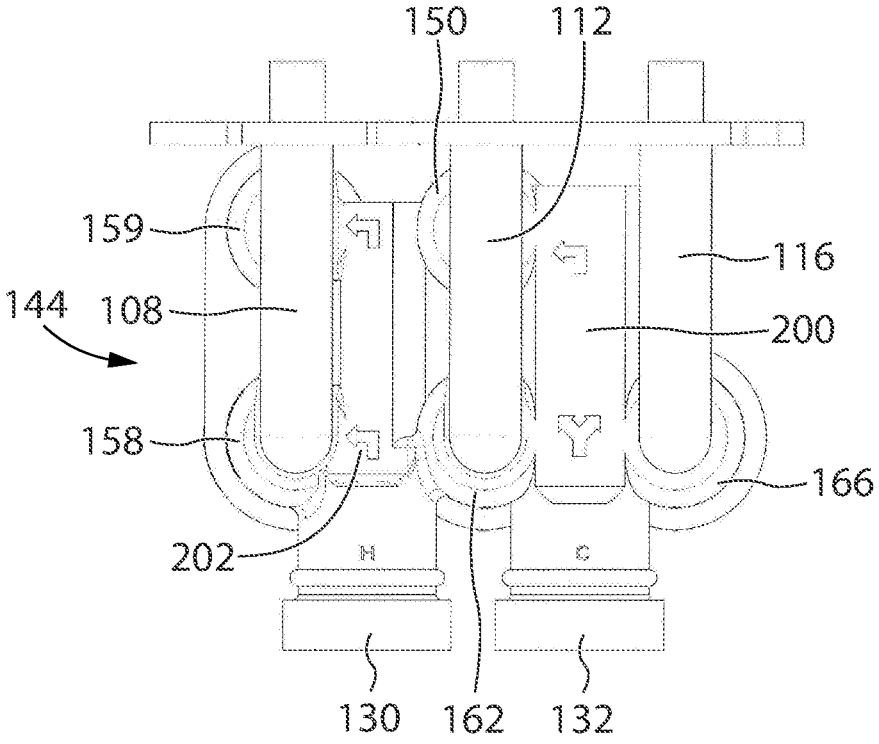
FIG. 18 shows the inlet water unit in a bottom view according to an alternative embodiment.

Also according to the preferred embodiment shown in FIG. 18, the inlet 132, in which the pipe connected to the cold water mains is preferably assembled, communicate with the valve actuator seats 150, 162, 166 so that when the water reaches the actuator seats 150, 162, 166, the water flows to the respective outlet port.

The invention thus conceived can be subjected to numerous modifications and variants all falling within the scope of the inventive concept.

For example, in FIG. 18 is disclosed the a bottom view of the inlet water unit 66 according to an alternative embodiment. In this view, some protuberances 108, 112, 116, 200, 202 from the valve body 144 are visible; these protuberances correspond to the channels connecting the inlets 130, 132 (connected to the pipe connected to the cold water mains) with the outlets of the valve body; according to the preferred embodiment shown in FIG. 18 the inlet 130, in which the pipe connected to the hot water mains is preferably assembled, communicate with the valve actuator seats 158 and 159 so that when the respective valve actuator opens said passage, preferably through the switch of the bobbin associated with the valve actuator seat 158 and 159, the water flows to the respective outlet port.

In addition, all details can be replaced by other technically equivalent elements. In practice, all the materials used, as well as the shapes and contingent dimensions, may vary depending on the requirements without departing from the scope of protection of the following claims.

The invention claimed is:

1. A household appliance, comprising:

a casing;

a washing tub configured to receive laundry;

a detergent dispenser configured to convey detergent/treating agents to the washing tub;

an inlet water unit configured to control and supply water to the detergent dispenser and/or the tub, the inlet water unit comprising:

a valve body, at least one inlet leading into the valve body, the at least one inlet being configured to connect to a water supply, and a plurality of outlets leading out of the valve body, the plurality of outlets facing in a first direction and configured to connect the valve body to the detergent dispenser and/or the tub, wherein the outlets are arranged, as viewed from a direction opposite the first direction, in at least two rows on the valve body, each of the at least two rows comprises at least two outlets arranged in a respective line, and the respective lines of the at least two rows are arranged in parallel to each other and spaced from each other in a direction perpendicular to at least one of the respective lines.

2. The household appliance according to claim 1, wherein the detergent dispenser comprises a drawer received in a drawer housing, and wherein the valve body is connected directly to a receiving body which is provided on the drawer housing.

3. The household appliance according to claim 2, wherein at least one outlet of the inlet water unit is connected to a respective channel of the receiving body by a sealing element.

4. The household appliance according to claim 2, wherein the receiving body is integrated with the drawer housing.

5. The household appliance according to claim 2, wherein the drawer comprises at least one detergent compartment and the drawer housing is associated with a flushing device, wherein the flushing device comprises at least a first channel communicating with the drawer compartment and at least a second channel in the receiving body.

6. The household appliance according to claim 5, wherein at least one second channel comprises horizontal inlet channel communicating with a respective vertically inclined outlet disposed to communicate with the flushing device.

7. The household appliance according to claim 5, wherein the flushing device in a mounted state of the appliance is arranged at least partially on top of the drawer housing.

8. The household appliance according to claim 1, wherein the valve body is configured to receive at least one valve actuator for selectively putting in fluid communication at least one inlet with a respective at least one outlet.

9. The household appliance according to claim 8, wherein at least one valve actuator comprises a solenoid valve.

10. The household appliance according to claim 9, wherein a respective solenoid valve is provided for each of the outlets, each solenoid valve being configured to open and close the respective outlet.

11. The household appliance according to claim 1, wherein a first row comprises three outlets, and a second row comprises two outlets.

12. The household appliance according to claim 11, wherein valve actuators provided for connecting at least one inlet with outlets of the second row are arranged closer to the at least one inlet than valve actuators provided for connecting at least one inlet with outlets with the first row.

13. The household appliance according to claim 12, wherein in a mounted state, the first row is arranged on a higher elevation compared to the second row.

14. The household appliance according to claim 1, wherein the detergent dispenser comprises at least two crossing channels configured to direct water passing therethrough into crossing water streams, and wherein the crossing channels are fluidly connected to outlets of the inlet water unit which are arranged in the same row.

15. The household appliance according to claim 2, wherein the valve body is configured to attach as a single unit to the receiving body, with each of the plurality of outlets in fluid communication with a respective channel of the receiving body.

16. The household appliance according to claim 15, wherein, when the valve body is attached to the receiving body, the respective channels of the receiving body face in a second direction opposite to the first direction.

17. The household appliance according to claim 15, wherein the valve body comprises a first face extending perpendicular to the first direction, the receiving body comprises a second face that abuts the first face when the valve body is attached to the receiving body, and the first face surrounds all of the outlets relative to the plane perpendicular to the first direction.

18. The household appliance according to claim 15, wherein the valve body comprises a first face extending perpendicular to the first direction, the receiving body comprises a second face that abuts the first face when the valve body is attached to the receiving body, and the plurality of outlets protrude in the first direction from the first face.

* * * * *